US006080974A

United States Patent [19]

Ambrosiano

[11] Patent Number: 6,080,974

[45] Date of Patent: Jun. 27, 2000

[54] CLOTHES- AND LINEN-WARMING OR DEHUMIDIFICATION APPARATUS

[75] Inventor: Mauro Ambrosiano, Albizzate-Varese, Italy

[73] Assignee: All 4 House S.P., Luxembourg, Luxembourg

[21] Appl. No.: 09/269,895

[22] PCT Filed: Sep. 30, 1997

[86] PCT No.: PCT/EP97/05357

§ 371 Date: Jun. 17, 1999

§ 102(e) Date: Jun. 17, 1999

[87] PCT Pub. No.: WO98/14105

PCT Pub. Date: Apr. 9, 1998

[30] Foreign Application Priority Data

Oct. 1, 1996 [IT] Italy ..... MI96A2014

[51] Int. Cl.[7] ..... H05B 3/50

[52] U.S. Cl. ..... 219/544; 219/528; 219/543; 392/416

[58] Field of Search ..... 219/385, 411, 219/528, 543, 545, 541, 548, 524, 521, 544; 392/416, 435; 428/204; 34/260

[56] References Cited

U.S. PATENT DOCUMENTS

| | | | |
|---|---|---|---|
| 3,244,858 | 4/1966 | Thorpe, Jr. | 219/345 |
| 3,626,152 | 12/1971 | Governale | 392/416 |
| 3,808,403 | 4/1974 | Kanaya et al. | 219/528 |
| 4,052,588 | 10/1977 | Nakamura et al. | 219/345 |
| 4,203,198 | 5/1980 | Hackett et al. | 29/611 |
| 4,371,579 | 2/1983 | McCaskey et al. | 428/204 |
| 4,591,701 | 5/1986 | Tokumaru | 219/543 |
| 4,694,146 | 9/1987 | DeMars | 219/524 |
| 4,927,995 | 5/1990 | Lovett et al. | 219/385 |
| 4,983,814 | 1/1991 | Ohgushi et al. | 219/545 |
| 5,023,433 | 6/1991 | Gordon | 219/548 |
| 5,315,765 | 5/1994 | Holst et al. | 34/260 |
| 5,932,129 | 8/1999 | Hyatt | 219/528 |

FOREIGN PATENT DOCUMENTS 3244858 5/1966 France .

OTHER PUBLICATIONS

PCT Notice of Tansmittal of the International Search Report, Form PCT/ISA/220, Sep. 30, 1997.

*Primary Examiner*—Teresa Walberg
*Assistant Examiner*—Leonid Fastovsky

[57] ABSTRACT

Clothes- and linen-warming or dehumidification apparatus (5) includes resistive means (25) for producing heat by the Joule effect and an electrically- insulating and thermally-conducting container (20) containing the resistive means (25) including at least one layer of resistive material arranged in track form, with the at least one layer (25) of resistive material having a non-homogeneous distribution such that it produces less heat in a central region of the apparatus (5).

19 Claims, 2 Drawing Sheets

CLOTHES- AND LINEN-WARMING OR DEHUMIDIFICATION APPARATUS

FIELD OF THE INVENTION

The present invention relates to a clothes- and linen-warming or dehumidification apparatus and, in particular, to an apparatus according to the preamble to the first claim.

BACKGROUND OF THE INVENTION

Apparatus which can warm and even dry clothes of various types, for example, shirts, jackets, jumpers, and/or various items of linen, for example, towels, bathrobes, dish-cloths, sheets, are known in the art. Hot-water warming apparatus constituted by tube structures connected to the heating system of a dwelling have a fixed structure, are expensive, require complex installation, and cannot be used when the heating system is inactive. Hot-air warming apparatus are very bulky, require a large amount of electrical energy and are quite noisy.

A particular kind of known heating apparatus which is quiet and easy to install produces heat by the Joule effect by means of a resistive wire in a serpentine arrangement. However, this apparatus is quite complex and expensive to produce; it is also prone to malfunction or damage. Finally, this known apparatus has a fairly high electrical power consumption of the order of about one hundred W.

OBJECTS AND SUMMARY OF THE INVENTION

The object of the present invention is to overcome the aforementioned drawbacks. To achieve this object, clothes- and linen-warming or dehumidification apparatus as described in the first claim is proposed.

The apparatus according to the present invention is very easy and inexpensive to produce; it can be made in any shape and size with minimal bulk and is therefore very practical and versatile.

A construction of this type produces extremely efficient apparatus with good uniformity of distribution of the heat produced; it has a very low electrical energy consumption and is therefore particularly suitable for domestic use and for continuous service.

Moreover, the apparatus according to the present invention is very safe and reliable.

DETAILED DESCRIPTION OF THE DRAWINGS

Further characteristics and advantages of the clothes- and linen-warming or dehumidification apparatus according to the present invention will become clear from the following description of a preferred embodiment thereof, given by way of non-limiting example, with reference to the appended drawings, in which.

DETAILED DESCRIPTION OF THE INVENTION

Figure 1:
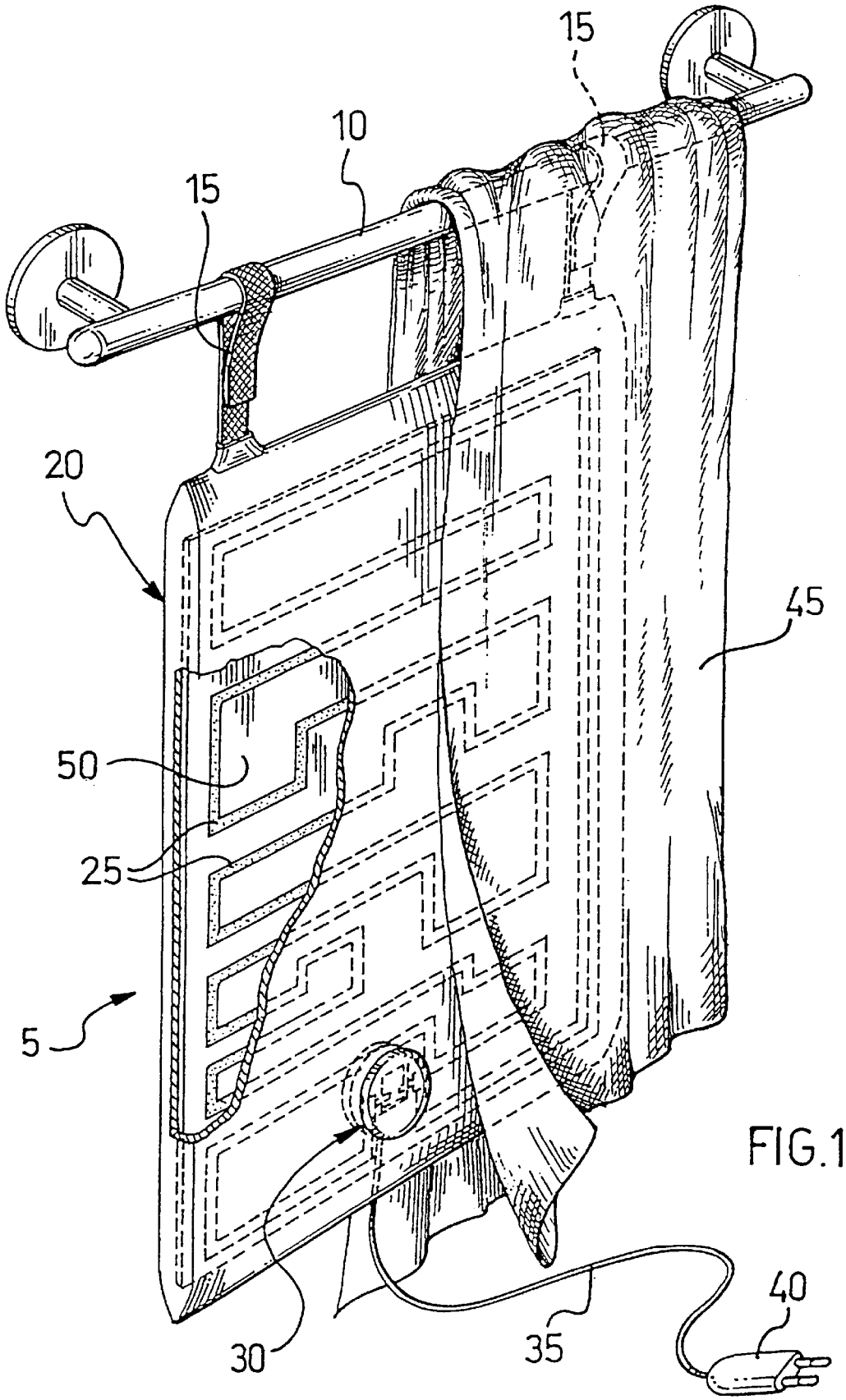
FIG. 1 shows the warming apparatus in a partially-sectioned view.

With reference to FIG. 1 in particular, this shows clothes- and linen-warming apparatus 5 hanging on a towel rail 10 by means of a pair of support straps 15; preferably, the support straps 15 are adjustable in height and can easily be unfastened in order to transfer the warming apparatus 5 to a different support element.

The warming apparatus 5 comprises an electrically-insulating and heat-conducting (rigid or flexible), typically rectangular, container 20. The container 20 is preferably constituted by two half-shells joined together (for example, glued or heat sealed) along a peripheral edge thereof and made of polyvinyl chloride (PVC) which withstands a working temperature of the order of 60°. The warming apparatus according to the present invention may, however, be made of any other equivalent material and in a manner such as to fit the shape of any garment or item of linen.

Inside the container 20 there is a layer 25 of resistive material arranged in the form of a track. In a particularly economically advantageous embodiment of the present invention, the layer 25 of resistive material is made of a conductive, for example, graphite-based paste commonly used in electronic printed circuits; alternatively, other equivalent materials such as paints based on carbon, metallic pigments, and the like may be used. The layer 25 of resistive material is connected by means of a suitable device 30 (described in detail below) to a flexible supply cable 35 terminating in a plug 40. The flexible cable 35 preferably has a coil structure so that its length can be adjusted to various electrical-mains supply-socket positions (not shown in the drawing); alternatively, a turret is provided for winding up the excess flexible cable 35 in the connection device 30, a flexible cable 35 of fixed length is used, or a battery supply-system is provided.

When the plug 40 is connected to the electrical-supply mains, a current passes through the layer 25 of resistive material and heat produced by the Joule effect is transferred out of the container 20. If a wet towel 45 is spread over the towel rail 10 so as to face the apparatus 5, it is quickly warmed and typically dried. The structure according to the present invention achieves a uniform distribution of the heat produced and therefore requires a low specific power, for example of the order of 10 $mW/cm^2$; typically, the layer 25 of resistive material has a total resistance of a few kΩ and the apparatus 5 requires a working power of the order of a few tens of W.

The present invention may also include a thermoregulation device and a fuse (not shown in the drawing) connected in series with the supply cable 35 to keep the working temperature of the warming apparatus 5 around a predetermined value, for example, of between 40° and 60°; it is thus possible to regulate the drying rate on the basis of the type of fabric of the towel 45. In an advantageous embodiment, the apparatus of the present invention also comprises a timing device which can switch it on cyclically; for example, the apparatus is switched on during the day and is automatically switched off at night so as further to reduce electrical-energy consumption.

It should be noted that the apparatus according to the present invention can be used in various situations. For example, in a different embodiment, the warming apparatus is fixed to a coat-hanger; this apparatus enables a garment to be warmed before it is put on or permits quick and brief ironing thereof. Alternatively, the warming apparatus is mounted on a trolley with wheels so that it can be moved easily from one room to another, or is fixed to the internal walls of a cupboard, a chest of drawers, or any other piece of furniture to eliminate dampness inside it, or is hung on a clothes airer to facilitate drying of clothes and linen; in this case, the apparatus is advantageously constituted by a plurality of heating elements suitably connected to one another electrically and arranged parallel or side by side.

In the preferred embodiment of the present invention shown in the drawings, the container 20 contains an electrically-insulating substrate 50. The insulating substrate 50 is constituted, for example, particularly economically, by a sheet of fireproof wood pulp (MDF); alternatively is it made of a laminate of bakelite, glass fibre, polyester, mica, Micarta, or the like. The layer 25 of resistive material is fixed to the insulating substrate 50 (irremovably), and is distributed by a silk-screen printing, immersion, spraying, pad-transfer printing, or rotogravure process or by electrostatic systems, or the like. The warming apparatus 5 advantageously comprises a further layer of resistive material (not visible in the drawing) fixed to the rear surface of the insulating substrate 50, that is, the opposite surface to the front surface on which the layer 25 of resistive material is fixed. The use of the substrate 50 improves the electrical insulation of the apparatus 5 so that this embodiment of the present invention is particularly safe. Alternatively, the layer 25 of resistive material is fixed directly to an internal surface of the container 20, without the need for a further substrate element; in this case, the container 20 is constituted by two sheets joined together to form a multi-layered structure.

The track formed by the layer 25 of resistive material extends on the substrate 50 to form a plurality of meanders. The layer 25 of resistive material advantageously has a non-homogeneous distribution so that less heat is produced by the layer 25 of resistive material in the central region of the apparatus 5; for example, this is achieved by a lesser concentration of meanders in the central region of the support 50 or by suitable variation of the thickness or of the width of the track 25. This achieves a more uniform distribution of the heat produced by the apparatus 5, compensating for the greater heat losses towards the exterior occurring in its peripheral region; this measure achieves greater efficiency of the warming apparatus 5. In the particular embodiment shown in the drawings, in which the warming apparatus is intended to be used in a vertical position, the distribution of the layer 25 of resistive material is such that it produces less heat in the upper region of the apparatus 5. This achieves a more uniform distribution of the heat by contact and by radiation, compensating for the circulation due to the convective motion of the hot air produced outside the apparatus 5, achieving greater efficiency thereof.

Several tracks of resistive material are preferably provided, electrically connected in series and/or in parallel with one another; the use of several small tracks offers the advantage of reducing the error, for example, in silk-screen printing, in the distribution of the resistive material on the surface of the substrate 50. Moreover, this measure permits the production of a single basic module which can easily be adapted to various supply-voltage and/or electrical-power values simply by variation of the connection of the various tracks of resistive material; this makes the process for the production of the warming apparatus more flexible and further reduces its production cost.

Figure 2:
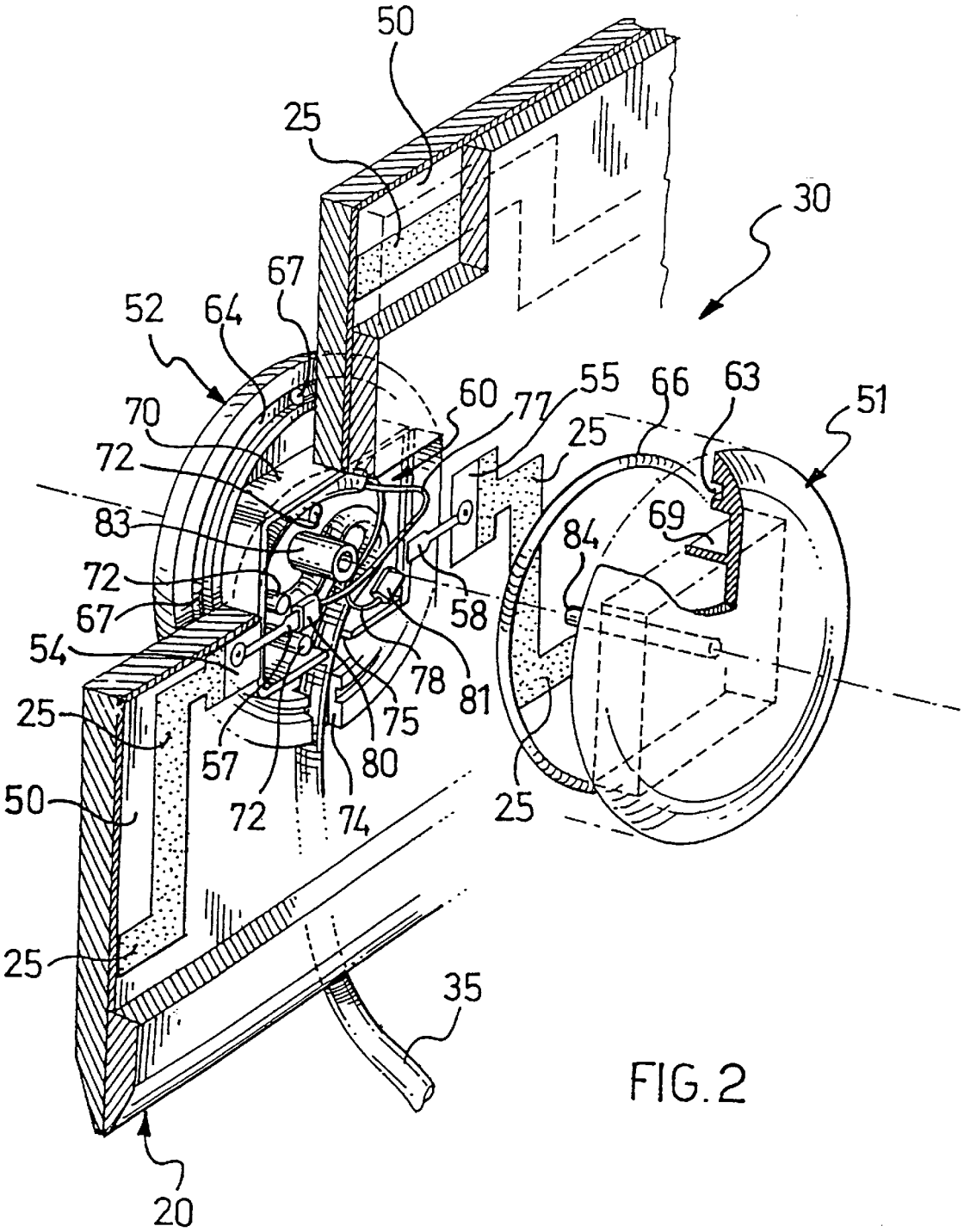
FIG. 2 is a view showing the device for connecting the apparatus of FIG. 1 to the electrical mains, with parts separated.

With reference now to FIG. 2 (the elements already shown in FIG. 1 are identified by the same reference numerals), the device 30 for connection to the electrical mains includes a front half-shell 51 and a rear half-shell 52 made, for example, of plastics material, disposed close to the free ends of the track defined by the layer 25 of resistive material; alternatively, only one half-shell is used, disposed, for example, in a front position. Each of the free ends is widened to form a pad to which is connected a supply terminal 54, 55 constituted by a metal strip (of any shape and size) made, for example, of copper or aluminium, fixed to the insulating substrate 50; alternatively, layers of material with low resistivity are provided, fixed to the insulating substrate 50 by methods similar to those used to form the layer 25 of resistive material. The metal strips 54, 55 are preferably glued to the insulating substrate 50 after the production of the layer 25 of resistive material (to prevent the risk of breakages of the layer 25) or before the formation of the layer 25 of resistive material (for example, in the case of thin metal strips 54, 55). A male element 57, 58 of a quick electrical connector known as a "faston" (or other equivalent means) is connected to the metal strip 54, 55; the male elements 57, 58 are accessible from outside the apparatus 5 through a through-hole 60 formed in the container 20 (and in the insulating substrate 50 if there is one).

Each half-shell (front or rear) 51, 52 has a slightly convex, for example, circular shape. A circular groove 63, 64 which houses a corresponding seal 66, 67 (for example, an O-ring) is formed on a peripheral edge of the half-shell 51, 52 facing the container 20. A frame 69, 70 extends perpendicularly inwards from a base of the half-shell 51, 52 and projects slightly from the plane defined by the peripheral edge of the half-shell 51, 52; the frame 69, 70 preferably has a non-circular, for example, square shape, so as to prevent any rotation of the half-shell 51, 52 (when fitted in the hole 60) relative to the container 20.

With reference, in particular, to the rear half-shell 52, one or more turrets 72 (three in the embodiment shown) extend perpendicularly from the base (inside the square frame 70) and are preferably of the same height as the square frame 70. Two holes 74 and 75 are formed in the peripheral edge of the rear half-shell 52 and in the square frame 70, respectively. The supply cable 35 extends through the holes 74, 75 and is wound around the turrets 72. The apparatus 5 can thus advantageously be supported by means of the supply cable 35 without any risk of damage; the connection device 30 may however, also be formed without these turrets (and the corresponding square frames) or by equivalent pull-resisting means. The supply cable 35 is constituted by an insulating sheath which surrounds two insulated conductor wires 77 and 78. A free end of each conductor wire 77, 78 extends out of the insulating sheath and is connected to a female element 80, 81 corresponding to the male element 57, 58.

A hollow turret 83 extends perpendicularly from the base of the rear half-shell 52 (in the centre of the square frame 70) and has a height slightly greater than that of the square frame 70; a pin 84 corresponding to the cavity of the turret 83 extends perpendicularly from the base of the front half-shell 51. Alternatively, two or more hollow turrets with respective pins or other equivalent means are provided for releasably connecting the half-shells 51 and 52.

During the assembly of the connection device 30, the male element 57, 58 is push-fitted in the corresponding female element 80, 81 so as to connect the layer of conductive material 25 electrically to the supply cable 35. The half-shells 51 and 52 thus bear against the container 20. The square frames 69 and 70 extend through the through-hole 60 and the pin 84 is push-fitted in the matching hollow of the turret 83; when the half-shells 51, 52 are arranged in abutment with the container 20, the square frames 69, 70 are separated by a space sufficient for the passage of the male elements 57, 58. The seal 66, 67 is thus compressed between the half-shell 51, 52 and the container 20; this ensures substantially hermetic closure of the connection device 30, preventing damage due to moisture. The connection device 30 described above can also be opened easily, for example, by action on the front half-shell Si with the tip of a screwdriver; this enables the supply cable 35 to be replaced easily and quickly. Alternatively, the front half-shell (or the rear half-shell) has a hole through which an insulating material (such as silicone) is injected in the liquid state, or other equivalent devices are used for connection to the electrical mains with a substantially hermetic seal.

It should be noted that the connection device described above can also be used in different electrical apparatus such as, for example, a mixer, a citrus-fruit squeezer and, in general, in all situations in which a hermetic connection to the electrical mains is required.

Naturally, in order to satisfy contingent and specific requirements, an expert in the art may apply to the above-described clothes- and linen-warming or dehumidification apparatus many modifications and variations all of which, however, are included in the scope of protection of the invention as defined by the following claims.

What is claimed is:

1. Clothes and linen warming or dehumidification apparatus (5) comprising:

resistive means (25) for producing heat by the Joule effect; and an electrically-insulating and heat-conducting container (20) enclosing the resistive means (25) wherein the resistive means (25) include at least one layer of resistive material distributed on an electrically-insulating substrate (50), the at least one layer being disposed in track form and in which the at least one layer (25) of resistive material has a non-homogeneous distribution such that it produces less heat in a central region of the apparatus (5).

2. Apparatus (5) according to claim 1, in which the at least one layer (25) of resistive material is distributed by a silk-screen printing process.

3. Apparatus (5) according to claim 1, in which the electrically-insulating substrate is constituted by an internal surface of the container (20).

4. Apparatus (5) according to claim 1, in which the electrically-insulating substrate is constituted by a board (50) provided inside the container (20).

5. Apparatus (5) according to claim 4, in which the board (50) is made of fireproof wood pulp.

6. Apparatus (5) according to claim 4, in which the board (50) has first and second opposite surfaces, the resistive means (25) including a first and a second layer of resistive material distributed on the first and second surfaces, respectively.

7. Clothes and linen warming or dehumidification apparatus (5) comprising:

resistive means (25) for producing heat by the Joule effect; and an electrically-insulating and heat-conducting container (20) enclosing the resistive means (25) wherein the resistive means (25) include at least one layer of resistive material distributed on an electrically-insulating substrate (50), the at least one layer being disposed in track form, wherein the apparatus (5) further comprises a substantially hermetically sealable device (30) for connecting the resistive means (25) to an electrical mains supply, in which the device (30) includes a first half-shell (51) and a second half-shell (52) connected to one another releasably through a through-hole (60) formed in the container (20), and a first seal (66) and a second seal (67) which are compressed between the container (20), and the first and the second half-shell (51, 52), respectively.

8. Clothes and linen warming or dehumidification apparatus (5) comprising:

resistive means (25) for producing heat by the Joule effect; and an electrically-insulating and heat-conducting container (20) enclosing the resistive means (25) wherein the resistive means (25) include at least one layer of resistive material distributed on an electrically-insulating substrate (50), the at least one layer being disposed in track form and in which the at least one layer (25) of resistive material has a non-homogeneous distribution such that it produces less heat in an upper region of the apparatus (5) when the apparatus (5) is arranged in a vertical position.

9. Apparatus (5) according to claim 1, in which the resistive material is a graphite-based conductive paste.

10. Apparatus (5) according to claim 7, in which at least one pin (84) and at least one hollow turret (83) extend perpendicularly inwards from a base of the first half shell (51) and from a base of the second half-shell (52), respectively, the at least one pin (84) being push-fitted in a matching recess in the corresponding hollow turret (83) through the through-hole (60).

11. Apparatus (5) according to claim 7, in which a frame (70) and a plurality of turrets (72) disposed inside the frame (70) extend perpendicularly inwards from the base of the second half-shell (52), the apparatus (5) further comprising a supply cable (35) wound around the turrets (72), and the second half-shell (52) and the frame (70) having a first hole (74) and a second hole (75), respectively, for the passage of the supply cable (35).

12. Apparatus (5) according to claim 1, further comprising a first supply terminal (54) and a second supply terminal (55) constituted, respectively, by a first and a second metal strip electrically connected to the at least one layer (25) of resistive material.

13. Apparatus (5) according to claim 1, in which the specific power developed by the apparatus (5) is of the order of 10 mW/cm2.

14. Apparatus (5) according to claim 1, further comprising thermoregulation means.

15. Apparatus (5) according to claim 1, further comprising a timing device for switching the apparatus (5) on cyclically.

16. Method for manufacturing a clothes and linen-warming or dehumidification apparatus (5) comprising the steps of:

a) providing resistive means (25) for producing heat by the Joule effect;

b) enclosing the resistive means (25) into an electrically-insulating and heat-conducting container (20), wherein the providing step a) includes distributing at least one layer of resistive material on an electrically-insulating substrate (50), the at least one layer being disposed in track form and in which the at least one layer (25) of resistive material has a non-homogeneous distribution such that it produces less heat in a central region of the apparatus (5).

17. Method according to claim 16, in which the step a) is performed by a silk-screen printing process.

18. Method according to claim 16, in which the step a) includes distributing a plurality of tracks of resistive material and connecting the plurality of tracks in series and/or in parallel.

19. Method according to any claim from 16, further comprising the step of electrically connecting a first (54) and a second (55) supply terminal constituted by a first and a second metal strip, respectively, to the at least one layer (25) of resistive material.

* * * * *

UNITED STATES PATENT AND TRADEMARK OFFICE

CERTIFICATE OF CORRECTION

PATENT NO. : 6,080,974

DATED : June 17, 1999

INVENTOR(S) : Ambrosiano

It is certified that error appears in the above-indentified patent and that said Letters Patent is hereby corrected as shown below:

On the title page: Item [73] Assignee: should read

--ALL 4 HOUSE S. A. --.

Signed and Sealed this

Third Day of April, 2001

*Attest:*

Nicholas P. Godici

NICHOLAS P. GODICI

*Attesting Officer*

*Acting Director of the United States Patent and Trademark Office*